US008336247B2

(12) United States Patent
Haering

(10) Patent No.: US 8,336,247 B2
(45) Date of Patent: Dec. 25, 2012

(54) CLAMPING SYSTEM FOR MOUNTING OPTICAL DEVICES ONTO A PICATINNY-RAIL

(75) Inventor: Walter Haering, Schweinfurt (DE)

(73) Assignee: G. Recknagel e.K. Precision Tradition Technology (DE)

( * ) Notice: Subject to any disclaimer, the term of this patent is extended or adjusted under 35 U.S.C. 154(b) by 0 days.

(21) Appl. No.: 12/971,724

(22) Filed: Dec. 17, 2010

(65) Prior Publication Data

US 2011/0146128 A1 Jun. 23, 2011

(51) Int. Cl.
*F41G 1/38* (2006.01)

(52) U.S. Cl. ..... 42/127; 42/124; 42/111

(58) Field of Classification Search ..... 42/127, 42/124, 111
See application file for complete search history.

(56) References Cited

U.S. PATENT DOCUMENTS

| | | | | |
|---|---|---|---|---|
| 3,750,318 | A * | 8/1973 | Burris | 42/127 |
| 4,310,980 | A * | 1/1982 | Pilkington | 42/127 |
| 4,845,871 | A * | 7/1989 | Swan | 42/127 |
| 4,934,085 | A * | 6/1990 | Lough | 42/127 |
| 5,430,967 | A * | 7/1995 | Woodman et al. | 42/114 |
| 5,680,725 | A * | 10/1997 | Bell | 42/127 |
| 5,787,630 | A * | 8/1998 | Martel | 42/125 |
| 5,941,489 | A | 8/1999 | Fanelli et al. | |
| 6,438,888 | B1 * | 8/2002 | Lin et al. | 42/114 |
| 6,442,883 | B1 * | 9/2002 | Waterman et al. | 42/124 |
| 6,629,381 | B1 | 10/2003 | Keng | |
| 6,922,934 | B1 * | 8/2005 | Huan | 42/127 |
| 7,272,904 | B2 | 9/2007 | Larue | |
| 7,308,772 | B1 * | 12/2007 | Millett | 42/127 |
| 7,370,449 | B1 * | 5/2008 | Beckmann | 42/90 |
| 7,493,721 | B2 | 2/2009 | Swan | |
| 7,543,405 | B1 * | 6/2009 | Ivey | 42/125 |
| 7,562,485 | B2 * | 7/2009 | Newhall et al. | 42/127 |
| 7,614,175 | B2 * | 11/2009 | Davis et al. | 42/127 |
| 7,735,255 | B1 * | 6/2010 | Kincaid et al. | 42/146 |
| 7,739,824 | B1 * | 6/2010 | Swan | 42/124 |
| 7,802,395 | B1 * | 9/2010 | Swan | 42/127 |
| 7,886,476 | B1 * | 2/2011 | Swan | 42/127 |
| 7,905,045 | B1 * | 3/2011 | Swan | 42/127 |
| 7,908,782 | B1 * | 3/2011 | LaRue | 42/128 |
| 7,946,074 | B2 * | 5/2011 | Nemec | 42/137 |
| 8,056,277 | B2 * | 11/2011 | Griffin | 42/71.01 |
| 8,104,211 | B2 * | 1/2012 | Darian | 42/90 |
| 8,112,933 | B1 * | 2/2012 | Swan | 42/127 |

(Continued)

FOREIGN PATENT DOCUMENTS

DE 102004008211 9/2005

OTHER PUBLICATIONS

Search Report in Application DE202009017398.

*Primary Examiner* — Michelle Clement
(74) *Attorney, Agent, or Firm* — Bourque and Associates, PA

(57) ABSTRACT

A clamping system for mounting accessory devices onto a rail type mount such as a Picatinny-rail is characterized in that the clamping system comprises at least one body which is passed through by a cross bolt or a cross screw and wherein the cross bolt or cross screw have a stop bar which engages in a cross slot when mounted to the rail of the rail type mount.

12 Claims, 11 Drawing Sheets

U.S. PATENT DOCUMENTS

| | | | | |
|---|---|---|---|---|
| 8,132,355 | B1 * | 3/2012 | Kincaid et al. | 42/124 |
| 2001/0022044 | A1 * | 9/2001 | Spinner | 42/124 |
| 2003/0101632 | A1 * | 6/2003 | Davenport et al. | 42/85 |
| 2006/0117636 | A1 | 6/2006 | Newhall et al. | |
| 2006/0207156 | A1 | 9/2006 | Larue | |
| 2008/0092421 | A1 * | 4/2008 | Beckmann | 42/90 |
| 2008/0155876 | A1 * | 7/2008 | Matthews et al. | 42/124 |
| 2008/0168696 | A1 | 7/2008 | Orne et al. | |
| 2008/0216380 | A1 | 9/2008 | Teetzel | |
| 2010/0107467 | A1 * | 5/2010 | Samson et al. | 42/127 |
| 2011/0061286 | A1 * | 3/2011 | Wang | 42/125 |
| 2011/0067287 | A1 * | 3/2011 | Collin et al. | 42/119 |

* cited by examiner

CLAMPING SYSTEM FOR MOUNTING OPTICAL DEVICES ONTO A PICATINNY-RAIL

FIELD OF THE INVENTION

The present invention relates to the rail mounting of accessories onto military and civilian firearms, helmets, belts and the like and more particularly, to a clamping system and method for mounting accessory devices onto a rail mount such as a Picatinny-rail which enables different ways of clamping by using the same body.

BACKGROUND OF THE INVENTION

In the military-tactical sector, Picatinny-rails, according to MIL-Std-1913, have prevailed as standardized interface for the mounting of scopes, red dot sights and lamps on firearms. But also for the mounting of accessory devices onto helmets, belts and the like, such rails are used for. Also in the sector of hunting rifles, Picatinny-rails are mounted and used.

For the mounting of accessory devices onto Picatinny-rails different clamping systems are known. Mounting systems, which are removed from the Picatinny-rail rarely, are clamped by means of clamping jaw and nut, depending on the type, and also by means of a clamping jaw and screw. These systems are convenient to handle, solid and inexpensive. However they have the disadvantage that a tool is needed.

Mounting systems, which are often attached and detached, such as they are for example used in the military-tactical sector, are mostly equipped with a lever system.

In the U.S. Pat. No. 7,493,721 B2 a mounting device is described, which is handled by means of a lever. A safety against unintentional opening of the lever does not exist. A handling of the mounting device by means of a cheaper nut is not described.

In the U.S. Pat. No. 7,272,904 B2 a mounting device, which is detachable by an adjusting lever, for mounting a device with quick-detachable connection onto a support member is described.

This mounting device describes a lever with adjustable gripping force. A safety against unintentional opening does not exist. With its clamping area the lever scrapes on the Picatinny-rail when being used and thus can damage the rail.

In the US-application 2006/0207156 A1 a rail clamp for firearms is described, which is operated by means of an adjusting lever and which is intended for the mounting of different accessory devices, like optical sights, laser sights, target illuminators onto different parts of a firearm, in order to guarantee the use of the firearm under different conditions at day and night.

In the US-patent application 2008/0168696 A1 devices and methods of mounting accessory devices onto a firearm are described. The devices show a rail connector and a quick-detachable device for being mounted onto a firearm. The connection shows at least one mounting rail and one fixing device for secure mounting of the connection directly onto the firearm. The quick-detachable device will then be mounted onto the mounting rail.

As for the object of this patent application, depending on the adjustment, the full clamping force takes effect without interposed spring element. Because of its cylindrical form, the yoke in the clamping system is not able to serve as a stop bar for the reception of heavy recoil as there is only partial contact in the transversal grooves of the Picatinny-rail, but no full contact.

In the US-patent application 2008/0178511 A1 devices and methods of mounting accessory devices onto a firearm are described, too.

A stepless adjustment of the lever is not possible. For adjusting the clamping force of the locking lever, the lever with jaw and yoke has to be shifted counter to the spring force until the nut is exposed. This results in the fact that once the lever with jaw and yoke is shifted counter to the spring force, unintentional adjustment is possible when not mounted onto the Picatinny-rail. Moreover the yoke is not permanently installed in the body. When used on semi-automatic and on automatic rifles the device is not only shifted forward because of the recoil, but alternately also undergoes a backward impulse, when the bolt moves rapidly forward. Thus relative motions between yoke and body can occur. This can result in damages to the body and to the Picatinny-rail as well as associated inaccuracies cannot to be excluded when re-mounting.

In the German patent application 10 2004 008 211 A1 a mounting device for firearms with one clamping device, one toggle lever assembly and two spring assemblies is described.

The gripping force of the lever is not adjustable. It is obtained by a spring assembly that is put under pressure when closing the lever. The stop is flange mounted only and does not pass through the mount base.

In the US-patent application 2006/0117636 A1 an assembly and a method are described, which enable to fix a coupling device onto an auxiliary device and to effectively use it for fixing an auxiliary device onto a dovetail rail.

Indeed the gripping force of the lever can be adjusted, but not steplessly. For adjusting, a screw has to be demounted what includes the risk of a loss. A safety against unintentional opening is not described.

Accordingly, what is needed is a clamping system for mounting accessory devices onto a rail system such as a Picatinny-rail, which clamping system is characterized in that it comprises at least one body which is passed through by a cross bolt or a cross screw and wherein the cross bolt or cross screw has a stop bar which engages in a cross slot when mounted to the rail.

SUMMARY OF THE INVENTION

It is an object of the present invention to provide a clamping system for accessory devices onto a Picatinny-rail which enables different ways of clamping by using the same body. At the same time, the fixing of the mounting body on the Picatinny-rail shall be made without interposed spring element and the clamping system shall show a very high strength.

According to the invention the object is solved by a clamping system for accessory devices onto a Picatinny-rail, which is characterized in that it comprises at least one body, which is passed through by a cross bolt or a cross screw and that said cross bolt or said cross screw have a stop bar, which engages in a cross slot, when mounted to the Picatinny-rail.

On the opposite side of the Picatinny-rail, the body shows at least one interface for installing accessory devices.

For weight reasons the body shall be manufactured from light metal. In order to withstand the recoil of very big calibres as well, the stop is manufactured from steel and from one piece and totally passes through the body across the Picatinny-rail.

The Body and stop may have a fixed connection. A stop bar machined out of the body across the Picatinny-rail would be of insufficient width as for manufacturing reasons and because of the making of the body from light metal of insufficient strength.

In a first embodiment the clamping system is characterized in that it comprises a locking lever at a cross bolt for its handling.

The clamping force of the locking lever is continuously adjustable. At the same time the cross bolt takes over the function of the recoil lug.

In a preferred embodiment said clamping system is characterized in that said body can be clamped onto said Picatinny-rail by means of a clamping element by a locking lever.

In an especially preferred embodiment of the invention, the clamping system is characterized in that one cross hole in said body is assigned to at least one counterboring for a screw.

In a further especially preferred embodiment of the invention the clamping system is characterized in that said cross bolt can be supported with its head on the lateral area of said body and that said cross bolt can pass through an aperture of said clamping element.

Furthermore a clamping system is especially preferred which is characterized in that said cross bolt comprises an internal thread with an adjustment screw on the opposite side of a head, whereby said adjustment screw can be secured by a thread lock. The thread lock is preferably realized as plastic insert. However the thread lock can also be realized as screw varnish or counterboring.

When not mounted onto the Picatinny-rail with its sliding surface, the clamping element of the clamping system can be pressed against the detent area of the locking lever in opened position by means of one pressure spring, preferably by two pressure springs.

In a further especially preferred embodiment of the invention, the clamping system is characterized in that a hinge pin is divided into a small cylindrical segment, a square and a large cylindrical segment, whereby the diameter of said small cylindrical segment is smaller than or as small as the square size and whereby the diameter of said large cylindrical segment is wider than the square size. The position of the hinge pin across the Picatinny-rail is determined by the adjustment screw, which is on the opposite side of the head.

In a further especially preferred embodiment of the invention, the clamping system is characterized in that said cross bolt comprises an oblong hole where the square of the hinge pin is slidably guided.

In a further especially preferred embodiment of the invention, the clamping system is characterized in that a safety catch passes through the slanted aperture and is pivoted in said locking lever by means of a piston.

As for the clamping system the cross bolt can have a lower sliding area and a sliding area running parallel to the first one. Furthermore as for the clamping system the small cylindrical segment of the hinge pin can be pivoted in the small hinge pin borehole of the locking lever and the large cylindrical segment of the hinge pin can be pivoted in the large hinge pin borehole.

The hinge pin of the clamping device can be secured contrary to the mounting direction against unintentional loss by means of a safety screw and with its step, can butt depending on the mounting direction, against the upper or the lower sliding area. Depending on the mounting direction of the hinge pin, if coming from below or above, the locking lever can point to the front or to the rear in direction of the Picatinny-rail. The hinge pin can be a cylindrical pin or a dowel pin and the locking lever depending on its mounting direction in direction of the Picatinny-rail can point to the front or to the rear. The adjustment screw can directly operate on the hinge pin, or a buffer pin can be used between adjustment screw and hinge pin.

The piston can be accomplished as a cylindrical pin, preferably as a dowel pin.

When mounted to the Picatinny-rail the safety catch with its claw can engage into the recess of the clamping element and the lug(s) can be clasped by the contact area of the claw and kept in position by means of the torsion spring or a pressure spring. Thus unintentional opening is prevented reliably.

In order to bring the locking lever into the open position, the safety catch must be released by overcoming the spring power of the torsion spring or of a pressure spring.

The clamping element can be provided with two recesses and two lugs, which are positioned at a distance of 180° around the centerline of the aperture.

In a second version the clamping device comprises a nut at a cross screw for its handling.

Both said cross bolt and said cross screw can be fixed to the body by calking or gluing.

According to the present invention, by using the same body, the clamping system for accessory devices can employ either a clamping jaw and a nut or a clamping element and a locking lever.

Furthermore the fixation of the mounting device onto the Picatinny-rail results without any interposed spring and is to be considered as a fixed connection.

The body has an angled area and a base area, which are arranged at an angle β between 0° and 90°, preferably 60°, to each other.

When mounted onto the Picatinny-rail, the body touches with its base area the upper surface of the Picatinny-rail and the fixed clamp touches the second lower contact area of the Picatinny-rail. When mounted to the Picatinny-rail, the body can also touch the first and second upper contact area and the fixed clamp can touch the second lower contact area and the body cannot touch the upper surface of the Picatinny-rail with its base area.

When mounted onto the Picatinny-rail, the clamping element with its clamping surface can touch the first lower contact area of the Picatinny-rail and with its shoulder it can touch the angled area of the body.

The upper side of the body serves for receiving accessory devices and it is equipped with appropriate interfaces like for example rings, boreholes, screw-on connections, studs, dovetail attachments.

It is important to note that the present invention is not intended to be limited to a device or method which must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

BRIEF DESCRIPTION OF THE DRAWINGS

These and other features and advantages of the present invention will be better understood by reading the following detailed description, taken together with the drawings wherein.

DETAILED DESCRIPTION OF THE DRAWINGS

Figure 1:
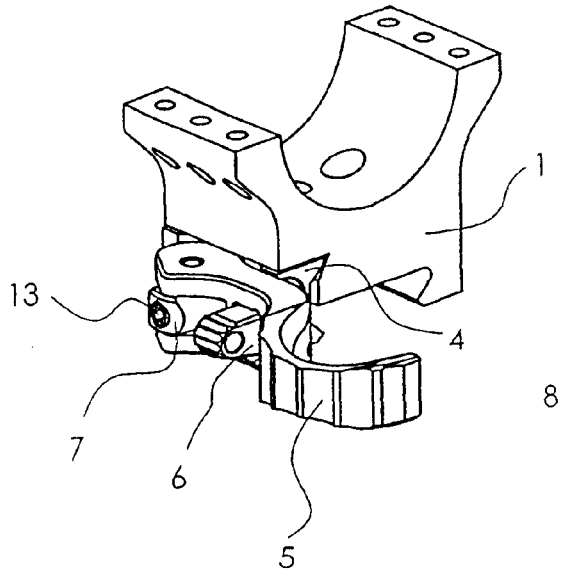
FIG. 1 a perspective view of the clamping system of the present invention showing a body 1 with clamping element 4 and locking lever 5 in locked position.
Figure 2:
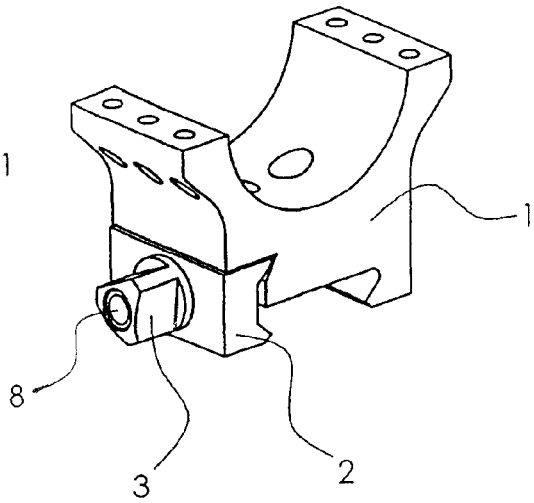
FIG. 2 is a perspective drying showing body 1 with clamping jaw 2 and nut 3 according to the present invention.

FIGS. 1 and 2 show the two versions of the invention, whereby the body 1 in FIG. 1 is shown with the cross bolt 7 and in FIG. 2 it is shown with the cross screw 8. The adjustment screw 13 can be screwed in the cross bolt 7. The adjustment screw 13 enables a stepless adjustment of the locking lever's 5 clamping force. The safety catch 6 juts through the locking lever 5. By means of which the clamping element 4 is mounted to the Picatinny-rail 10.

In the case of the cross screw 8, the clamping jaw 2 is mounted to the Picatinny-rail 10 by means of the nut 3.

Figure 3:
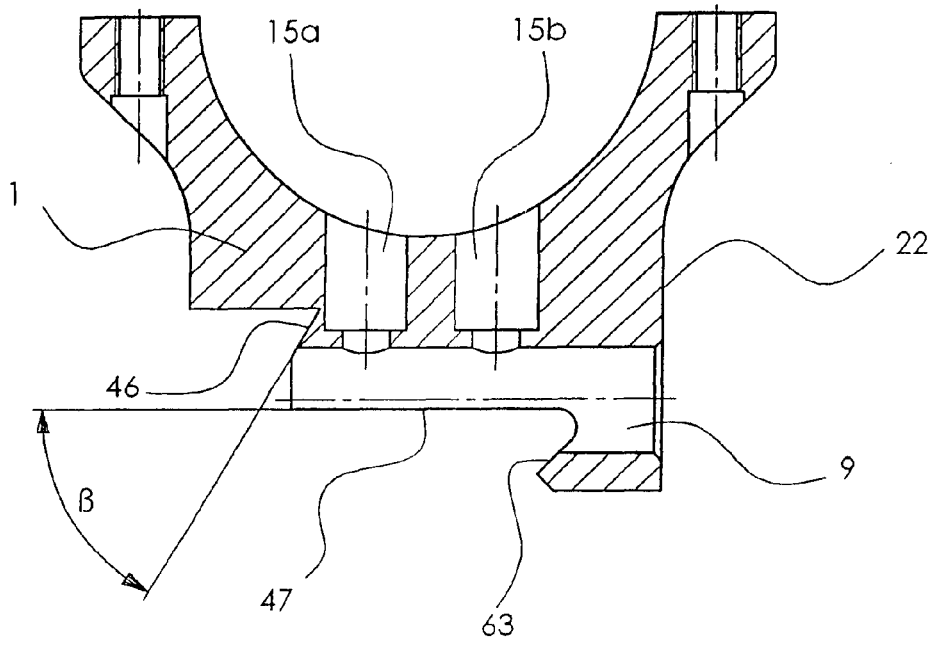
FIG. 3 is a cross-sectional view of body 1 without the clamping system.

In FIG. 3 the cross hole 9 can receive both the cross screw and the cross bolt 7. Each body 1 is provided with at least one cross hole 9. Each cross hole 9 is assigned to at least one counterboring 15*a* and/or 15*b*, by means of which the cross screw or the cross bolt 7 is attached to by one screw 16*a*, 16*b* (FIG. 5) each. The body 1 is pictured exemplary with an interface in the form of a half-shell for mounting a scope.

Figure 4:
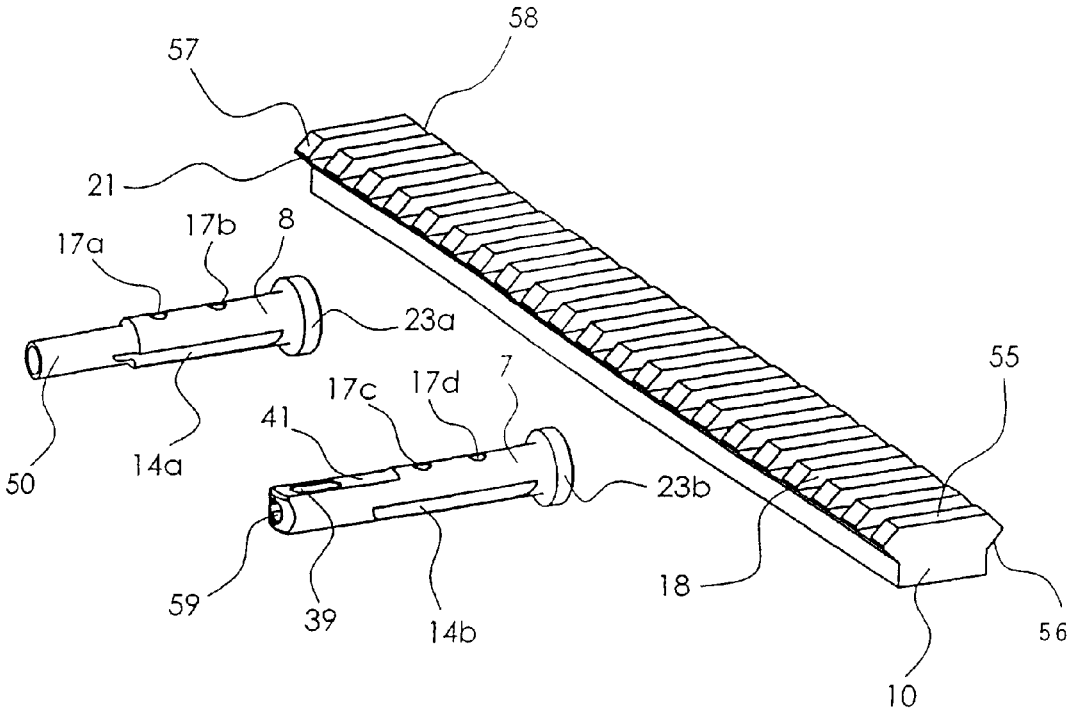
FIG. 4 is a perspective view showing cross screw 8, the cross bolt 7 and a Picatinny-rail 10.

In FIG. 4 the cross bolt 7 and the cross screw 8 are provided each with at least one internal thread 17*a*, 17*b*, 17*c*, 17*d*, which serves for fixation in the body 1 by means of the screws 16*a*, 16*b*. When mounted, the stop bar 14*a* or 14*b* engages in one of the cross slots 18 of the also pictured Picatinny-rail 10 and receives the recoil when used as a mount on firearms.

Figure 5:
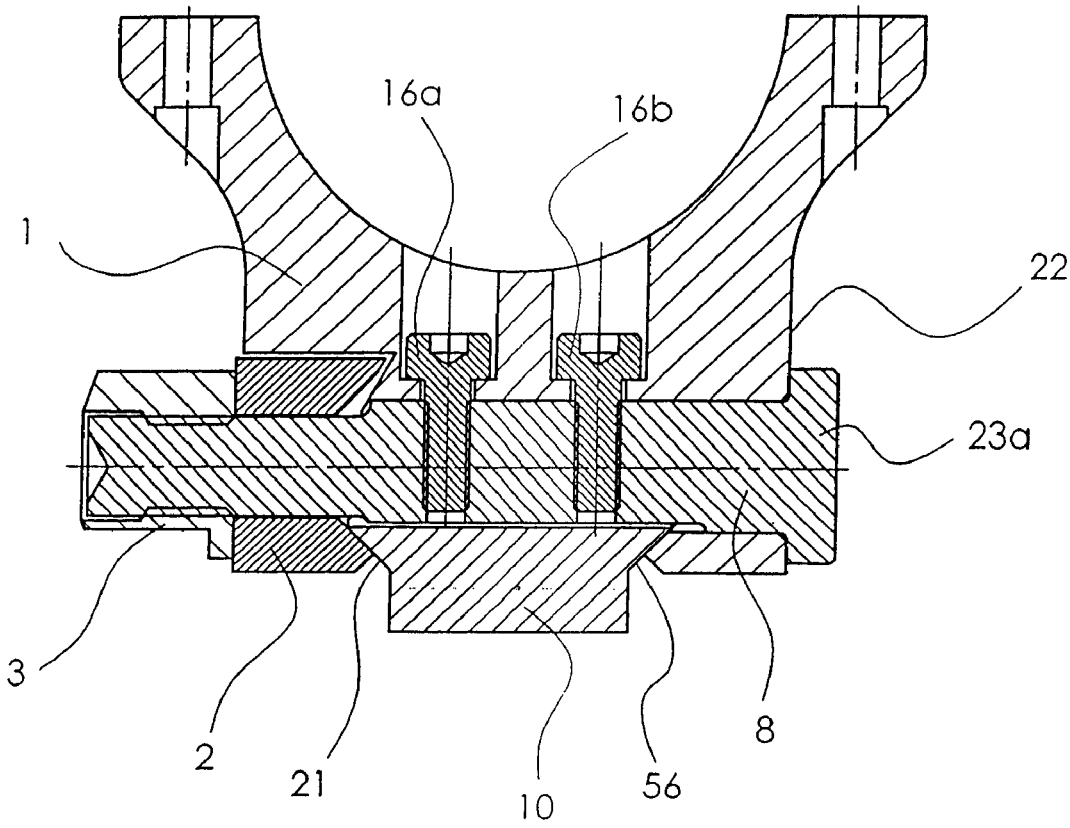
FIG. 5 is a cross-sectional view showing body 1 with clamping jaw 2 and nut 3, mounted to a Picatinny-rail 10.
Figure 8:
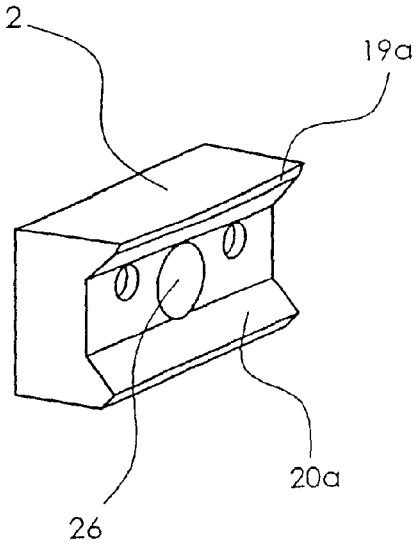
FIG. 8 is a perspective view showing clamping jaw 2 with shoulder 19*a*, of clamping area 20*a* and borehole 26.

In FIG. 5 the cross screw 8 for receiving the nut 3 is provided with an outside threaded region 50. With its clamping area 20*a* (see FIG. 8), the clamping jaw 2 touches the first lower contact area 21 of the Picatinny-rail 10 and touches the angled area 46 of the body 1 by means of its shoulder 19*a*. The angled area 46 and the base area 47 are arranged at an angle β between 0° and 90°, preferably 60°, to each other. The head 23*a* of the cross screw 8 is to be supported on the lateral area 22 of the body 1. The cross screw 8 passes through the borehole 26 of the clamping jaw 2. In order to attach the body 1 to the Picatinny-rail 10 the nut 3 is to be tightened. Hereby the base area 47 of the body 1 touches the upper surface 55 of the Picatinny-rail 10 and the fixed clamping jaw 63 touches the second lower contact area 56.

In an additional, not shown, embodiment of the invention, the body 1 does not touch the upper surface 55 of the Picatinny-rail 10 when being attached. When the body 1 touches the second lower contact area 56 this is provided by the fixed clamping jaw 63 and additionally it is provided by means of two additional contact areas to the first and second upper contact area 57 and 58 of the Picatinny-rail 10. The clamping area 20*a* of the clamping jaw 2 and the clamping area 20*b* of the clamping element 4 touch the first lower contact area 21 of the Picatinny-rail 10.

Figure 6:
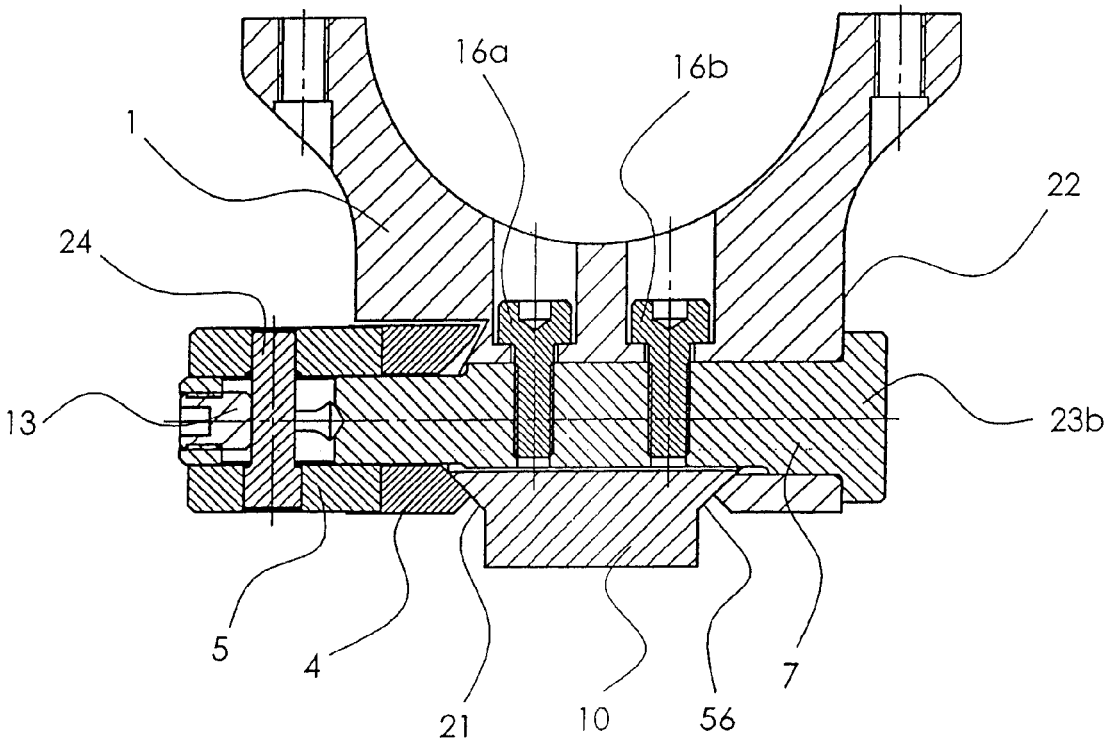
FIG. 6 is a cross-sectional view showing body 1 with clamping element 4 and locking lever 5, mounted to a Picatinny-rail 10.

In FIG. 6 the clamping element 4 touches the first lower contact area 21 of the Picatinny-rail 10 by means of its clamping area 20*b* (see FIG. 7) and touches the angled area 46 of the body 1 with its shoulder 19*b*. The head 23*b* of the cross bolt 7 is supported on the lateral area 22 of the body 1. The cross bolt 7 passes through the aperture 27 of the clamping element 4. By means of the adjustment screw 13, which works on the square 37 of the hinge pin 24, the clamping force of the locking lever 5 can be adjusted steplessly. In the version of a pin or a dowel pin, the adjustment screw 13 works on the hinge pin 24 diameter directly. In order to avoid a deformation in this case because of the partial contact, a hardened buffer pin, not shown here, can be interposed.

Figure 7:
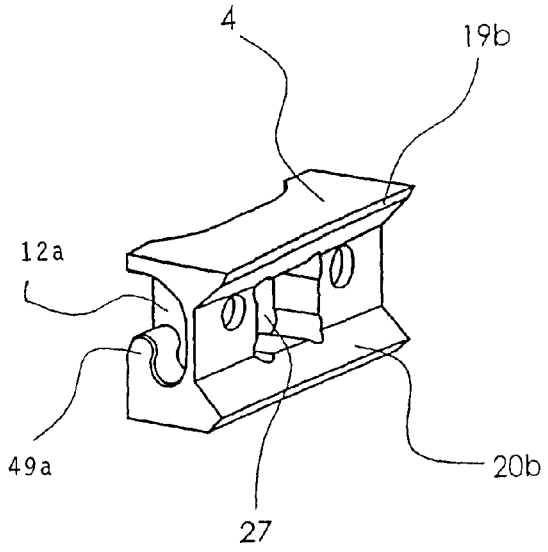
FIG. 7 is a perspective view showing clamping element 4.

FIG. 7 shows the clamping element 4 with the shoulder 19*b*, the clamping area 20*b*, the aperture 27 as well as with the recess 12*a*. The lug 49*a* serves for locking with the claw 11 of the safety catch 6.

Figure 9:
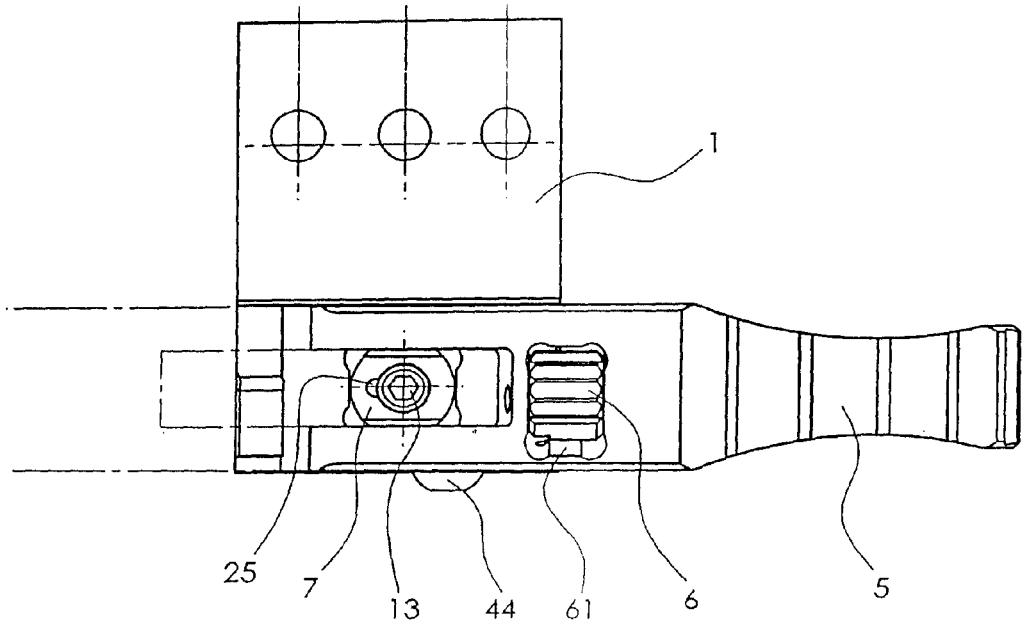
FIG. 9 is a side view of body 1 with clamping element 4 and locking lever 5 showing a second possible position of locking lever 5.

In FIG. 9 the adjustment screw 13 is secured from twisting by means of thread lock 25. Other kinds of screw safeties, as for example safety varnish or a counter screw are possible, too.

Figure 10:
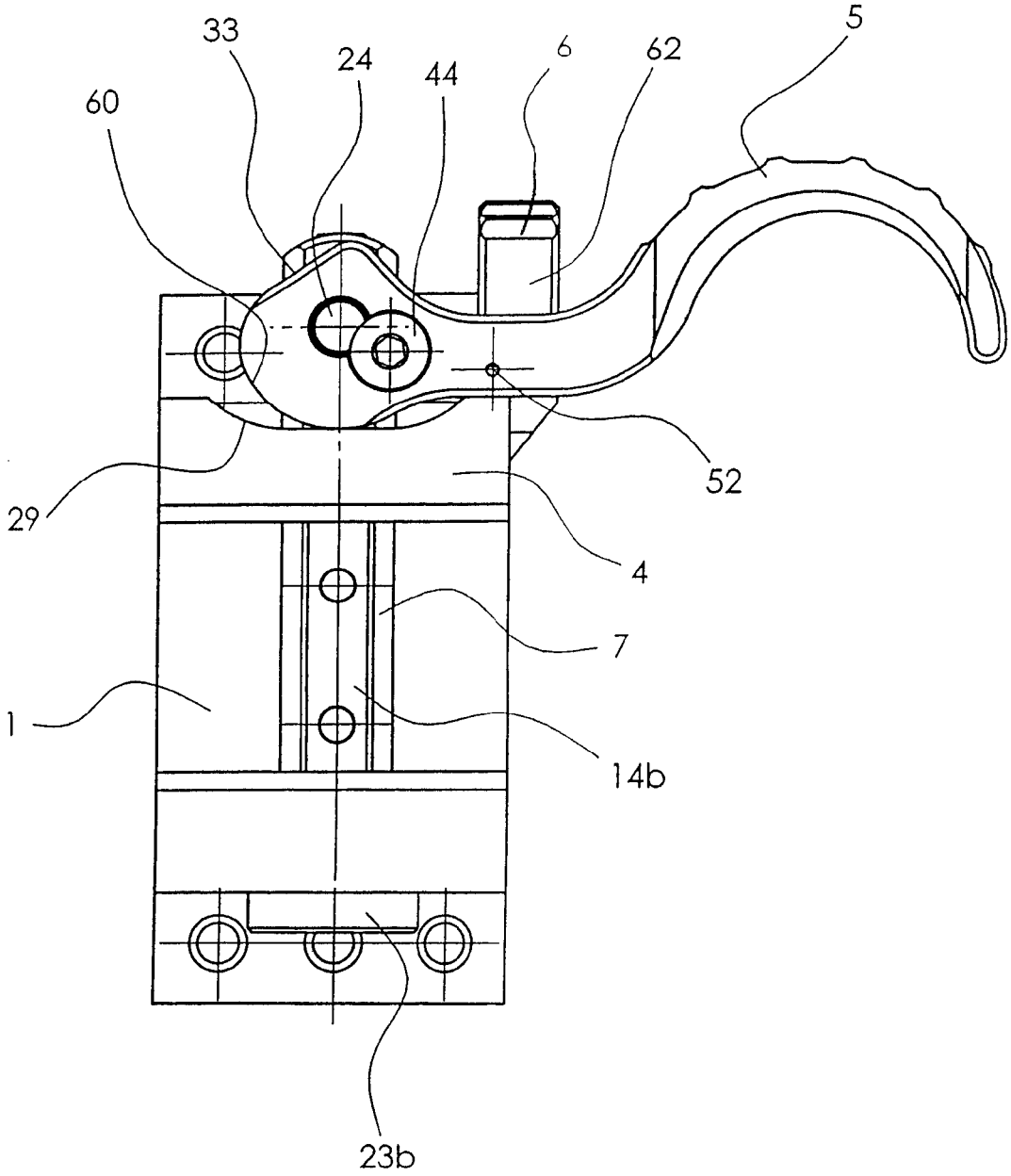
FIG. 10 is a bottom view of body 1 with clamping element 4 and locking lever 5 in locked position.

In FIG. 10 the locking lever 5 shows an eccentric device 60, which is aligned to the small hinge pin borehole 42 and to the large hinge pin borehole 43. In this position the side surface 28 of the eccentric device 60 presses against the sliding surface 29 of the clamping element 4.

Figure 11:
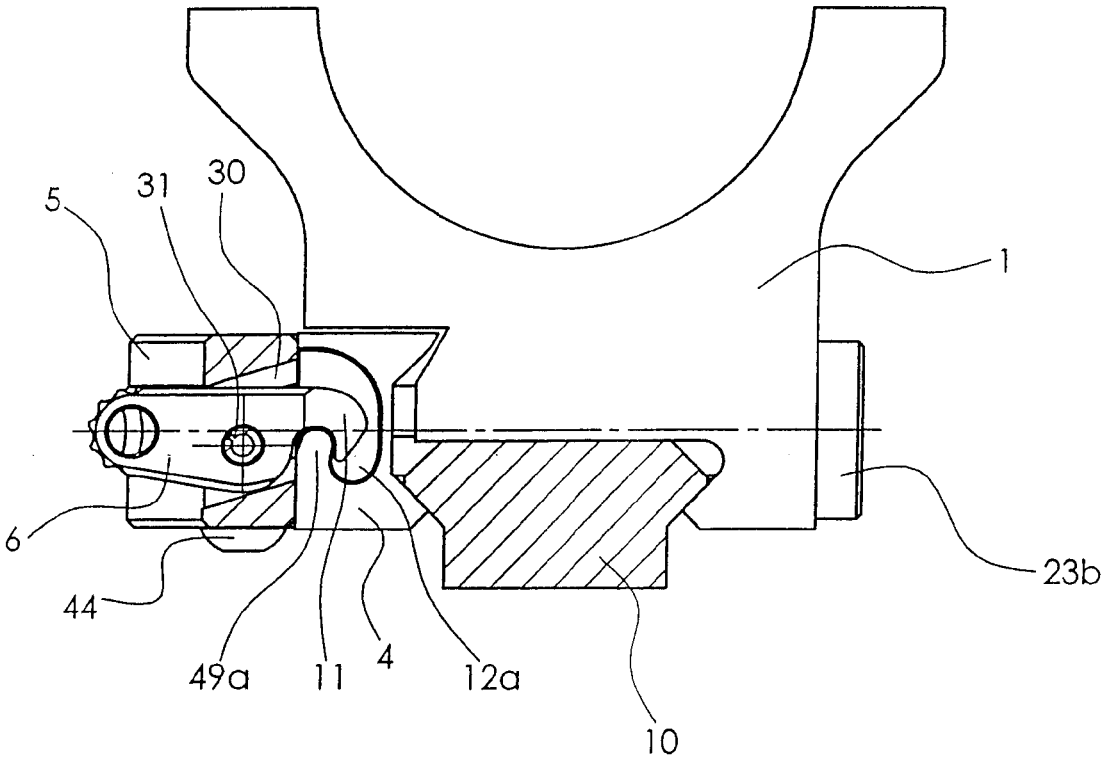
FIG. 11 is a rear view of body 1 with clamping element 4 and locking lever 5 in locked position.

In FIG. 11 the locking lever 5 was cut in the area of the slanted running aperture 30. In this position with its claw 11, the safety catch 6 engages in the recess 12*a* or 12*b* of the clamping element 4. The lugs 49*a* or 49*b* are clasped by the contact area 48 of the claw 11. By means of the piston 31 the safety catch 6 is pivoted in the locking lever 5 and entirely passes it through the aperture 30.

Figure 12:
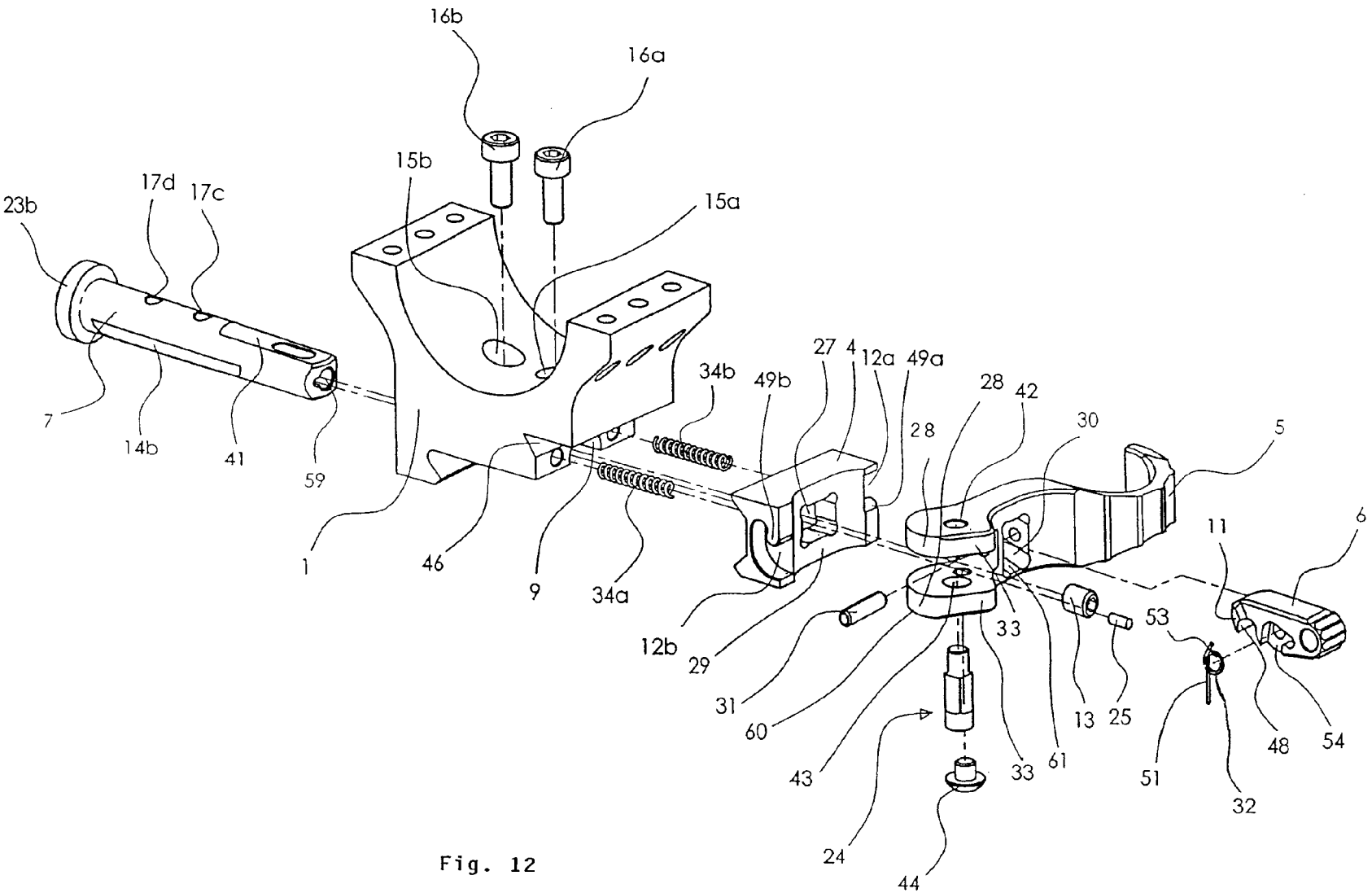
FIG. 12 is an exploded view of body 1 with clamping element 4 and locking lever 5.

In FIG. 12 the first leg 51 of the torsion spring 32 engages in the recess 52 of the locking lever 5. The second leg 53 of the torsion spring 32 engages in the recess 54 of the safety catch 6 and forces it into the position shown in FIG. 11. Instead of the torsion spring 32 between the wall 61 and the outer surface 62 of the safety catch 6, there can be a pressure spring not shown here. In order to bring the locking lever 5 in the open position, the safety catch 6 has to be released in the opposite direction of the torsion spring's 32 spring pressure or of the pressure spring.

Figure 13:
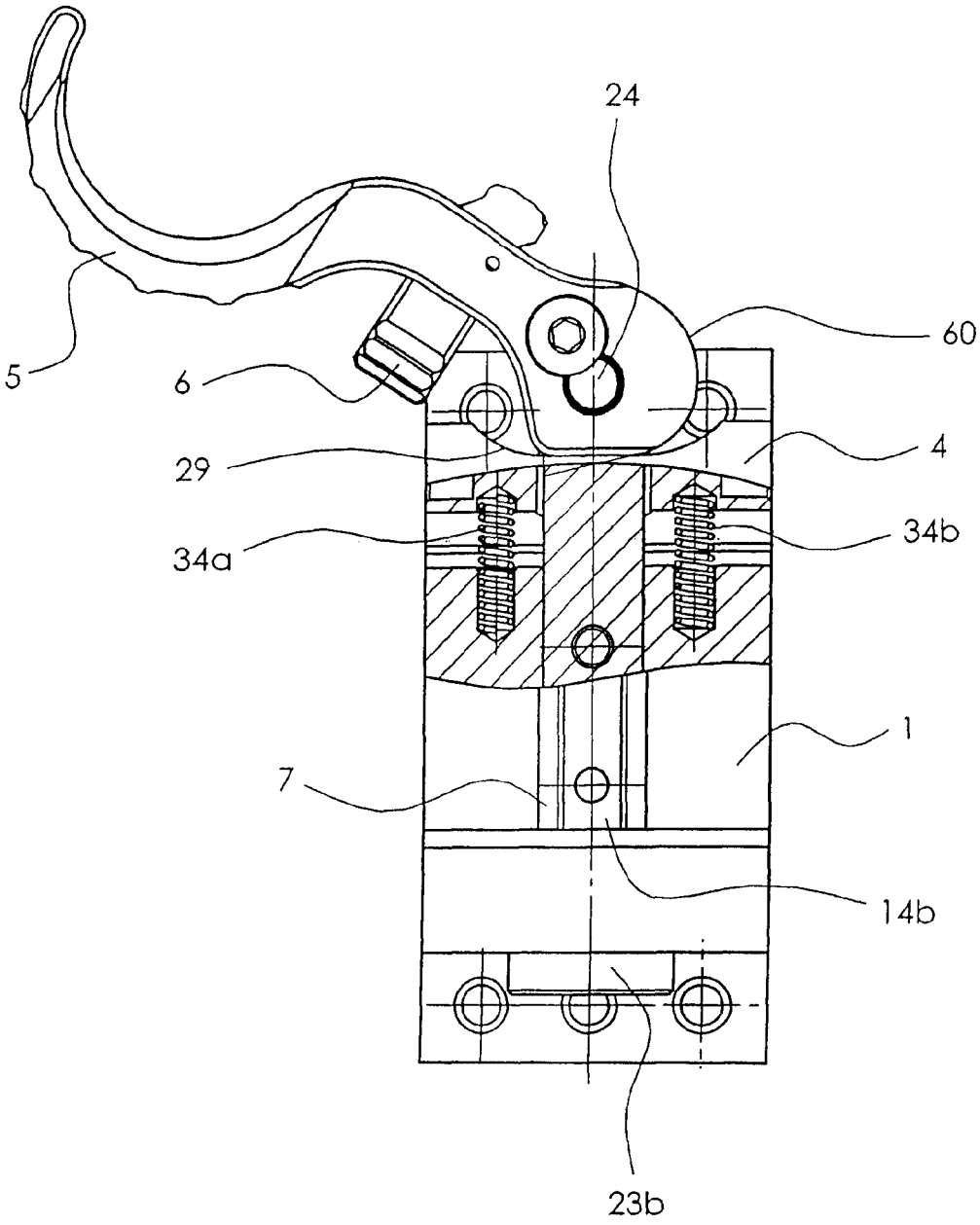
FIG. 13 is a bottom view of body 1 with clamping element 4 and locking lever 5 in an open position.

FIG. 13 shows the locking lever 5 in open position. At least one pressure spring 34*a* and/or 34*b* pushes the sliding surface 29 of the clamping element 4 against the detent area 33 of the locking lever 5. FIG. 13 shows a preferred embodiment with two pressure springs 34*a* and 34*b*. So the contact area 21 of the Picatinny-rail 10 is released and the body 1 with clamping system can be removed.

Figure 14:
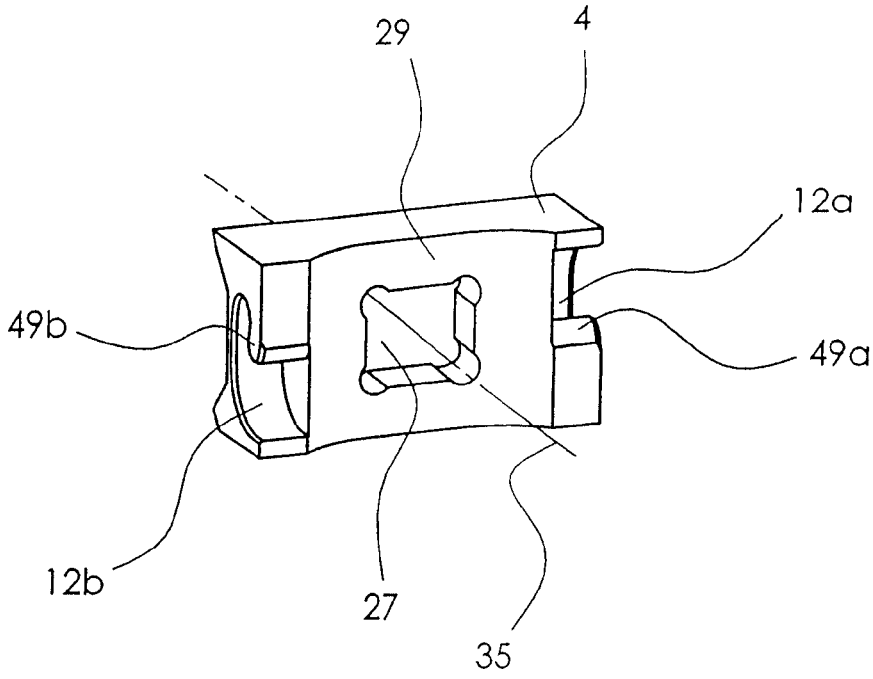
FIG. 14 is a perspective view of clamping element 4.

FIG. 14 shows the clamping element 4 with center line 35 of the aperture 27 for the cross bolt 7 drawn in. The recesses 12*a* and 12*b* as well as the lugs 49*a* and 49*b* are aligned around the center line 35 at a distance of 180° each.

Figure 15:
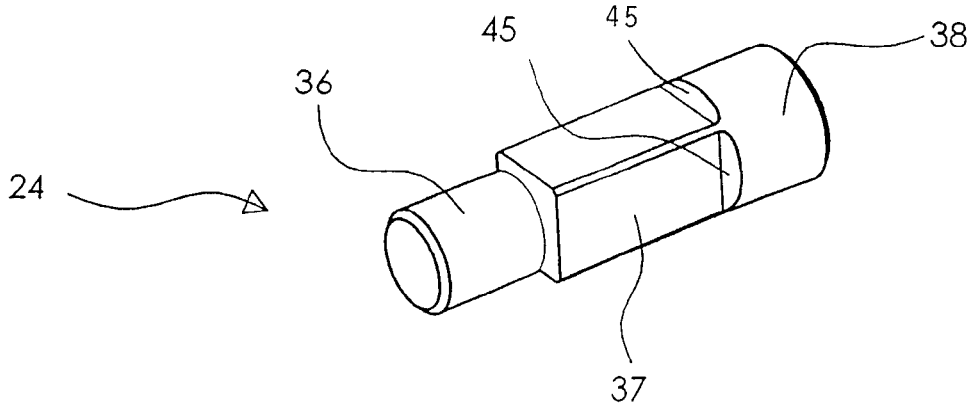
FIG. 15 is a perspective view of hinge pin 24.

Because of its outer shape, in FIG. 15 the hinge pin 24 can be divided into three parts 36, 37 and 38. The diameter of the small cylindrical segment 36 is equal to or smaller than the square size 37. The diameter of the large cylindrical segment 38 is wider than the square size 37.

Figure 16:
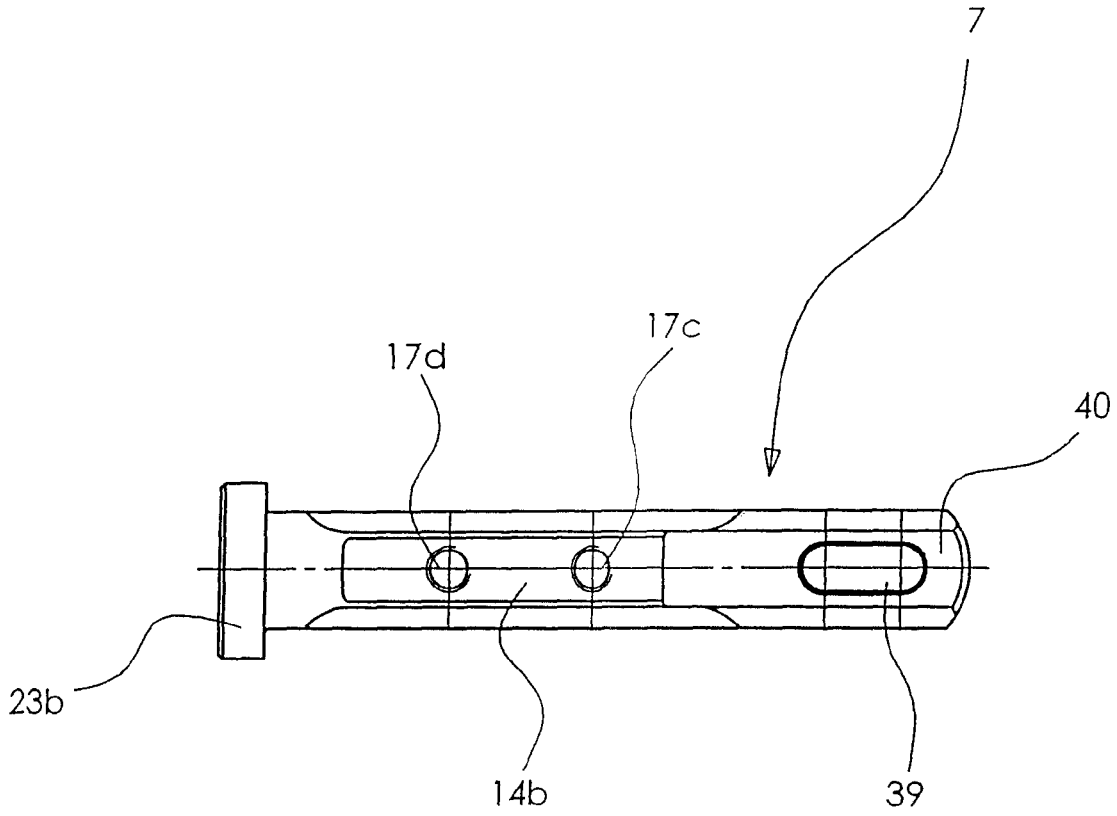
FIG. 16 is a bottom view of cross bolt 7.

FIG. 16 shows the cross bolt 7 with the oblong hole 39 and the lower sliding area 40. Opposite to the lower sliding area 40, the upper sliding area 41 is situated. When mounted, with its square 37 the hinge pin 24 is slidably guided in the oblong hole 39 of the cross bolt 7. Its small cylindrical segment 36 is pivoted in the small hinge pin borehole 42 of the locking lever 5 and the large cylindrical segment 38 is pivoted in the large hinge pin borehole 43. By means of the safety screw 44, the hinge pin 24 is secured against loss in the opposite direction of its installation. In the mounting direction, with its step 45, the hinge pin 24 bumps the lower sliding area 40 or the upper sliding area 41. Thus depending on the direction of mounting the hinge pin 24 from below or from above in direction to the Picatinny-rail 10, the locking lever 5 points forward or backwards.

LIST OF REFERENCE NUMBERS

| | |
|---|---|
| 1 | body |
| 2 | clamping jaw |
| 3 | nut |
| 4 | clamping element |
| 5 | locking lever |
| 6 | safety catch |
| 7 | cross bolt |
| 8 | cross screw |
| 9 | cross hole |
| 10 | Picatinny-rail |
| 11 | claw |
| 12a, 12b | recess in clamping element 4 |
| 13 | adjustment screw |
| 14a, 14b | stop bar |
| 15a, 15b | counterboring |
| 16a, 16b | screw |
| 17a, 17b, 17c, 17d | internal thread |
| 18 | cross slot |
| 19a, 19b | shoulder |
| 20a, 20b | clamping area |
| 21 | first lower contact area |
| 22 | lateral area |
| 23a, 23b | head |
| 24 | hinge pin |
| 25 | thread lock |
| 26 | borehole |
| 27 | aperture |
| 28 | side surface of eccentric device 60 |
| 29 | sliding area of clamping element 4 |
| 30 | slanted aperture |
| 31 | piston |
| 32 | torsion spring |
| 33 | detent area |
| 34a, 34b | pressure spring |
| 35 | center line |
| 36 | small cylindrical segment |
| 37 | square |
| 38 | large cylindrical segment |
| 39 | oblong hole |
| 40 | lower sliding area |
| 41 | upper sliding area |
| 42 | small borehole for hinge pin 24 |
| 43 | large borehole for hinge pin 24 |
| 44 | safety screw |
| 45 | step |
| 46 | angled area |
| 47 | base area |
| 48 | contact area of claw 11 |
| 49a, 49b | lug |

-continued

| | |
|---|---|
| 50 | outside thread |
| 51 | first leg of torsion spring 32 |
| 52 | recess for torsion spring 32 |
| 53 | second leg of torsion spring 32 |
| 54 | recess in safety catch 6 |
| 55 | upper surface of Picatinny-rail |
| 56 | second lower contact area |
| 57 | first upper contact area |
| 58 | second upper contact area |
| 59 | internal thread |
| 60 | eccentric device |
| 61 | wall |
| 62 | outer surface |
| 63 | fixed clamping jaw |

Modifications and substitutions by one of ordinary skill in the art are considered to be within the scope of the present invention, which is not to be limited except by the allowed claims and their legal equivalents.

The invention claimed is:

1. A clamping system for removably clamping accessory devices onto a Picatinny-rail characterized in that the clamping system comprises at least one body (1), which is passed through by one of a cross bolt (7) or a cross screw (8), and wherein said one of said cross bolt (7) or said cross screw (8) have a stop bar (14*a* or 14*b*), which engages in a cross slot (18) in said Picatinny-rail when said clamping system is mounted to said Picatinny-rail (10), wherein said engagement is configured to occur in a lateral area (22) of said cross slot (18) and configured to be a full contact engagement, wherein at least one of a head (23*b*) of the cross bolt (7) or a head (23*a*) of the cross screw (8) is configured to be supported by the lateral area (22) of the at least one body (1) thereby preventing the one of said cross bolt (7) or said cross screw (8) from shifting across the body (1) when a clamping force is adjusted by an adjustment screw (13) at an opposite side of the head (23*b*) or when a clamping lever (5) is operated.

2. The Clamping system as in claim 1, characterized in said body (1) is assigned to at least one counterboring (15*a*; 15*b*) for a screw (16*a*; 16*b*).

3. The clamping system as in claim 1, characterized in that said cross bolt (7) can pass through an aperture (27) of a clamping element (4).

4. The clamping system as in claim 1, characterized in that said cross bolt (7) comprises an internal thread (59) with an adjustment screw (13) on the opposite side of said head (23*b*).

5. The clamping system as in claim 4, characterized in that said adjustment screw (13) is secured by a thread lock (25).

6. The clamping system as in claim 1, characterized in that a hinge pin (24) is divided into a small cylindrical segment (36), a square (37) and a large cylindrical segment (38), whereby a diameter of said small cylindrical segment (36) is smaller than or as small as the size of said square (37) and wherein a diameter of said large cylindrical segment (38) is larger than the size of said square (37).

7. The clamping system as in claim 6, characterized in that said cross bolt (7) comprises an oblong hole (39), where said square (37) of said hinge pin (24) is slidably guided.

8. The clamping system as in claim 1, characterized in that a safety catch (6) passes through a slanted aperture (30) and is pivoted in said locking lever (5) by means of a piston (31) and encompasses a lug (49*a* or 49*b*) with its contact area (48) of claw (11) when clamped into said Picatinny-rail.

9. The clamping system as in claim 1, characterized in that it comprises a nut (3) at a cross screw (8) for its handling.

10. The clamping system as in claim 1, characterized in that said cross bolt (7) or said cross screw (8) are fixed in the body (1) by means selected from the group consisting of screwing, calking and gluing.

11. A clamping system for removably clamping accessory devices onto a mounting rail, said mounting rail having a top surface and a bottom surface, said top surface having a plurality of generally evenly spaced raised protrusions and wherein said top surface includes a plurality of slots, one slot located between each pair of raised protrusions, said clamping system characterized in that the clamping system comprises at least one body (1), which is passed through by one of a cross bolt (7) or a cross screw (8), and wherein said one of said cross bolt (7) or said cross screw (8) have a stop bar (14*a* or 14*b*), which engages in a cross slot (18) in said mounting rail when said clamping system is mounted to said mounting rail (10), characterized in that a hinge pin (24) is divided into a small cylindrical segment (36), a square (37) and a large cylindrical segment (38), and wherein a diameter of the small cylindrical segment is equal to or less than a diameter of the large cylindrical segment.

12. The clamping system of claim 11, wherein said mounting rail is a Picatinny-rail.

* * * * *